United States Patent [19]

Brandberg et al.

[11] 3,973,045

[45] Aug. 3, 1976

[54] POPCORN PACKAGE FOR MICROWAVE POPPING

[75] Inventors: Lawrence C. Brandberg; David W. Andreas, both of Minneapolis, Minn.

[73] Assignee: The Pillsbury Company, Minneapolis, Minn.

[22] Filed: May 14, 1973

[21] Appl. No.: 359,810

[52] U.S. Cl. ..... 426/110; 229/DIG. 3; 229/515; 229/62; 426/111; 426/113; 426/123; 426/234

[51] Int. Cl.[2] ..... B65B 25/22

[58] Field of Search ..... 426/113, 118, 111, 234, 426/237, 241, 243, 106, 107, 410, 412, 415, 110; 229/57, 62, DIG. 3

[56] References Cited

UNITED STATES PATENTS

| | | | |
|---|---|---|---|
| 1,916,854 | 7/1933 | Bischoff | 229/57 |
| 2,480,679 | 8/1949 | Spencer | 426/106 |
| 2,495,435 | 1/1950 | Welch | 426/234 |
| 2,604,407 | 7/1952 | Martin | 426/324 |
| 2,702,246 | 2/1955 | Kinsella | 426/106 |
| 2,757,855 | 8/1956 | Allen | 229/62 |
| 2,815,883 | 12/1957 | Robins et al. | 426/111 |
| 2,865,768 | 12/1958 | Barnes et al. | 426/111 |
| 3,052,554 | 9/1952 | Colman | 426/111 |
| 3,187,480 | 6/1965 | Feeney et al. | 426/415 X |
| 3,519,439 | 7/1970 | Dunn | 426/111 |
| 3,567,111 | 3/1971 | Baxter et al. | 229/57 |
| 3,582,363 | 6/1971 | Jones | 426/410 |
| 3,615,712 | 10/1971 | Keller | 426/113 |
| 3,620,774 | 11/1971 | Ford et al. | 426/127 X |
| 3,676,058 | 7/1972 | Gray | 426/237 X |
| 3,689,291 | 9/1972 | Draper | 426/113 |
| 3,704,133 | 11/1972 | Kracauer | 426/171 X |
| 3,741,778 | 6/1973 | Rowe | 426/118 X |
| 3,851,574 | 12/1974 | Katz et al. | 426/111 X |

*Primary Examiner*—Steven L. Weinstein
*Attorney, Agent, or Firm*—James V. Harmon; Michael D. Ellwein

[57] ABSTRACT

A package of popcorn which is ready for popping in a microwave oven of from about 600 to 1,400 watts capacity is composed of a flexible and expandable package e.g. a gussetted bag formed from paper. The package is sealed to permit internal pressure to develop to expand the bag so that the corn has sufficient space for the increased volume assumed after popping. The charge of popcorn in the bag is uniformly mixed with about 1 to 5 parts by weight of a shortening for each 8 parts by weight of corn. The shortening comprises an edible solid or liquid fat and the package contains salt for flavoring.

5 Claims, 5 Drawing Figures

POPCORN PACKAGE FOR MICROWAVE POPPING

FIELD OF THE INVENTION

The invention relates to microwave cooking and more particularly to ready-to-pop packages of popcorn suited for microwave heating.

THE PRIOR ART

Institutional microwave ovens have in the past years been made in a variety of sizes including some of 3,000–5,000 watts or more. In recent years, however, the Institutional microwave ovens which have been adopted on a wide scale usually have a capacity of from about 600 to about 1,400 watts. Examples are the Litton Industries Inc. Model No. 550 or 70/50. Institutional microwave ovens having a capacity greater than 1,400 watts are less common and ovens with a capacity over 2,000 watts are prohibitively expensive for many applications. In tests conducted in the course of development of the present invention with ovens of the capacity of from 600 to 1,400 watts it was found that iniformity of heating caused by the presence of hot and cold spots was sometimes a problem. Moreover, in a number of tests which were conducted using prior popcorn packages such as those described in the Jones Pat. No. 3,582,363 or the Spencer Pat. No. 2,480,679 a large proportion of the corn would remain unpopped. However, if sufficient time is allowed to pop most of the corn, burning becomes a problem. To be satisfactory, it is generally acknowledged that at least 60% and preferably 75% or more of the kernels in the package must be popped. The popped kernels must be unburned and of sufficent volume. The ratio of popped to unpopped corn should be at least 35/1. Packages prepared in accordance with the above mentioned patents were unsatisfactory in these respects when popped in ovens of from 600 to about 1,400 watts capacity.

OBJECTS OF THE INVENTION

The objects are to provide an improved popcorn package suited for popping in a microwave oven having a capacity of from about 600 to about 1,400 watts and (a) providing a popped to unpopped volume ratio from at least 35, (b) at least 75% of the kernels being popped, (c) less than 5% of the kernels being burned and (d) a satisfactory flavor, aroma and texture and no tendency to be soggy, (e) a package that can be quickly opened without burning fingers.

THE FIGURES

SUMMARY OF THE INVENTION

Figure 1:
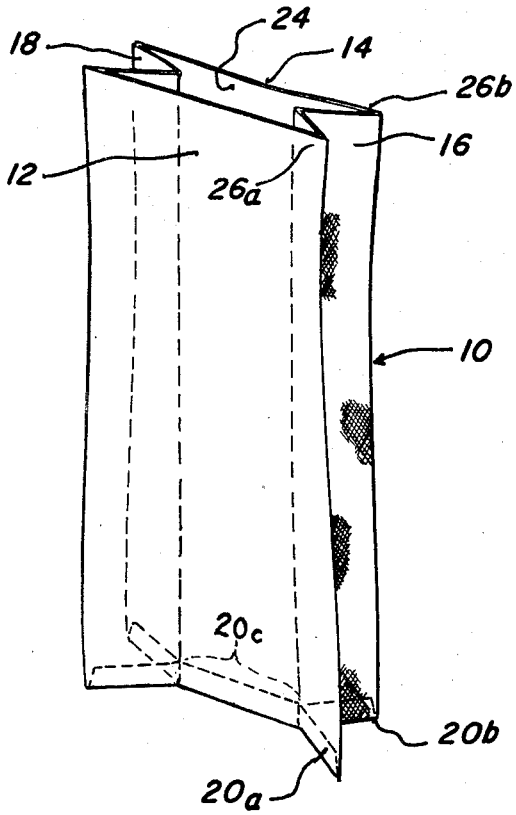
FIG. 1 is a perspective view of an empty package embodying the invention.

Briefly, the invention provides a package of popcorn which is ready for popping in a microwave oven as small as 600 watts capacity. The package includes a flexible and expandable body such as a gussetted bag formed from two plys of paper. The package has no openings or vents of any kind so that steam given off while heating will expand the bag. Eight parts of popcorn in the package is uniformly mixed with about one to five parts by weight of shortening i.e. fat. The package also contains salt for flavoring. The terms "shortening" and "fat" as used herein mean any edible cooking oil or plastic fat, whether solid or liquid and include both hydrogenated and non-hydrogenated shortenings of animal or vegetable origin. Butter will not serve the purpose of the invention and is specifically excluded.

The shortening provides a heat transfer medium for conducting heat evenly between the individual kernels in spite of the presence of hot or cool spots in the package. The package in addition to being flexible and expandable is relatively leak proof at least during the period of time the product is being cooked.

The shortening or fat can comprise any of a variety of edible animal or vegetable oils or plastic fats with those of vegetable origin being preferred because of their lower melting points.

THE PREFERRED EMBODIMENTS

As seen in the figures, a flexible package 10 is provided which consists of paper sidewalls 12 and 14 with longitudinally extending gussets 16 and 18 on each side to provide a sizeable expansion volume. The bottom is sealed tightly by transverse seals 20*a* and 20*b* which merge at the center 20*c*. The package preferably consists of two layers of flexible sheet material. One preferred outer sheet material is bleached kraft paper. A suitable liner 24 consists of glasine paper. The packages are preferably dispensed from a refrigerated vending machine. One preferred formula is: yellow popcorn 66.6%, cocoanut oil 25.0% and salt 8.4%.

It is important to reliably seal the ends of the package but at the same time permit ready access to its contents. This is accomplished by a top closure consisting of a rectangular section 27 of the bag folded downwardly into abutting relationship with the adjacent portion of the bag body 29 and sealed thereagainst by a transversely extending tape 31 having adhesive on its inward surface. The tape 31 is provided with a rip means such as a string S which when pulled sever longitudinally the adjacent portion of tape 31 thereby allowing the bag to be opened. The top portions of the bag gussets are held in place by folded section 27 and therefore cannot pop out laterally allowing the hot moisture vapor to escape when pressure develops inside the bag. This assures expansion of the bag and maintains the bag at its maximum volume.

The package should be completely sealed since expansion is dependent on the natural emission of moisture from the corn during heating. The volume of the bag should continue to be larger than the volume of popped corn through the entire popping process allowing the popped kernels to achieve the maximum size possible. When heated, bag expansion begins rather slowly but as corn begins popping, the rate increases to stay ahead of volume of corn being generated. A restriction of the bag volume will result in burning.

Most adhesives absorb microwave energy well. This can result in a failure of the closure or even ignition and burning of the bag. To eliminate this problem, the tape 31 employs a thermoplastic e.g. polyethylene heat seal coating to bond the tape to the bag. The package and especially the adhesive is susceptible to burning because of the high energy intensity and long heating cycle needed. The product is heated for approximately 2½ minutes (three times longer than a sandwich) and presents a fairly small load to any microwave oven. This causes a relatively large amount of free energy in the cavity. This energy will heat the bag and the top seal to a much higher degree than would be the case in other food products. Thus, adhesives in a sandwich bag are not nearly the problem they are here.

After popping the bag is very hot. It was previously quite difficult to remove and open the bag without a good chance for a painful burn due to the escaping steam. The free end 35 of tape which extends beyond the side edge of the bag makes for a relatively cool ear by which to remove bag from the oven and completely eliminates this problem.

For a 100 gm. charge of corn, oil, and salt the present invention will provide a final popped volume of from about 1600 c.c. to about 2400 c.c. While a charge of 120 gm. will provide a final volume of from about 1800 c.c. to 3200 c.c.

Figure 5:
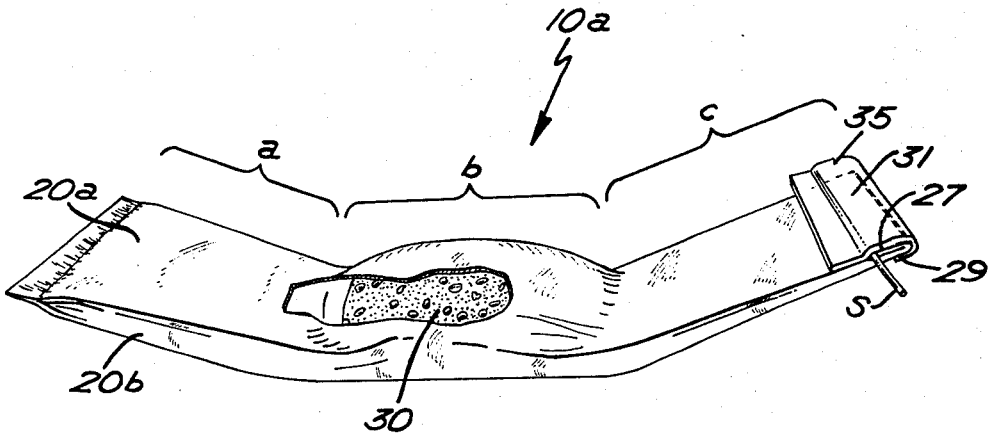
FIG. 5 is a perspective view of another form of the invention.

In a preferred form of the invention (FIG. 5) the gussetted, duplex bag is folded into three sections designated *a*, *b*, and *c* of FIG. 5 for storage in vending machines. The disk shaped charge 30 is contained in the center section *b*.

Figure 3:
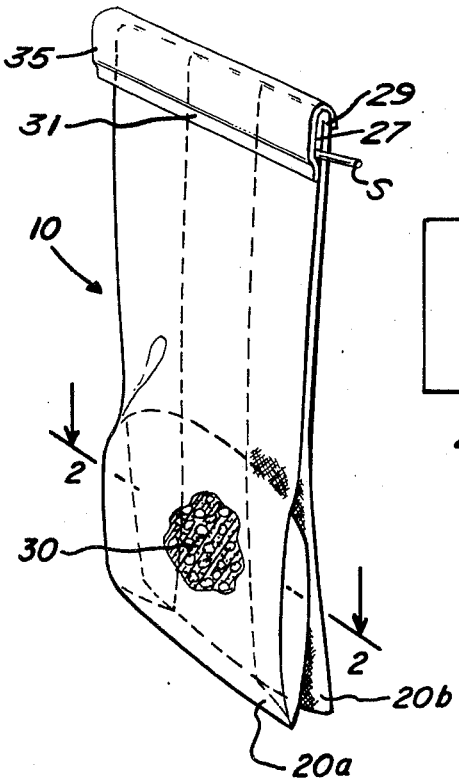
FIG. 3 is a perspective view of the sealed and filled package prepared in accordance with the invention.
Figure 4:
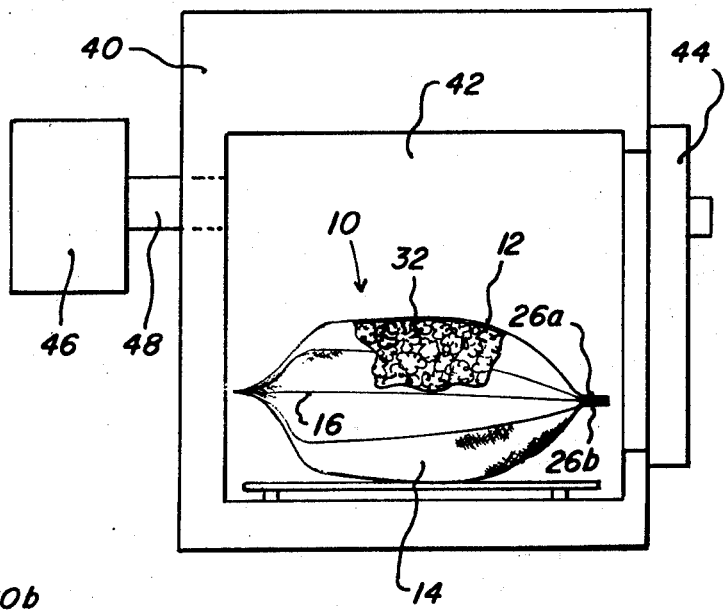
FIG. 4 is a vertical sectional view of the package as it appears when it is being popped in a microwave oven.

The charge location has definite effects on performance. For maximum efficiency, the charge is located in the center of the bag. If shortening solidifies in the bottom of a bag as it does in FIG. 3, it is gripped by the gussetts. Good bag inflation cannot occur until this grip has been loosened by the melting of the shortening. Moreover, if contained in the bottom of the bag as shown in FIG. 3, the charge of corn and shortening has a pointed lower edge because of the trough shape of the bottom of the bag. Thus the package of FIG. 3 is not as efficient as the disk shaped corn and shortening charge 37 of FIG. 5 placed in the center of the bag.

When popping begins and bag inflation takes place, expansion of popped corn commonly occurs in one direction when stored as in FIG. 3. If in the center, as in FIG. 5, it can expand upward and laterally in two directions. After the bag is fully inflated, the center section has the rough shape of a hemisphere which is very efficient from a popping standpoint. Oil can collect in a pool and unpopped kernels will tend to collect there because of the vibrations of the bag and gravity. The center of most microwave oven cavities is designed by the manufacturers to be a region of high density. With product in center of bag as shown in FIG. 5, there is control over the location of the charge in the oven cavity and an optimum chance for locating the charge 37 at the peak energy zone of the oven the approximate center. If charge is in bottom of the bag as in FIG. 3, it can more easily become located in a region of low energy.

Since bag expansion is to be facilitated, the bag walls should not be too stiff, light weight Kraft and glasine is suitable. Adding salt to the oil helps expansion by helping the product absorb the energy, but the salt must be evenly distributed in order to obtain an evenly salted final product. Even then, a large portion of the salt ends up as a layer on the inside of the bag. A consumer who wishes his corn saltier than the way it comes simply shakes the bag for a few seconds before opening it. The moisture content of the corn should be 10%–18% by weight and preferably from 13%–14% by weight. All quantities and percentages herein are on a weight basis unless otherwise indicated.

In the package of FIG. 5 the bag top is trimmed off square and portion 27 which is typically ¼ of an inch in height is folded down over section 28. The tape 31 is applied off-center so that the folded part 27 is under ⅔ of the tape and the bag body is under ⅓. This will hold the flap 27 securely in place and keep the gussets from folding out when the bag inflates. The tape with the tear string applied thereto is adhered so that the string is over the folded area. When pulled, the string tears the tape and also releases the folded bag top. With no fold or too small a fold, the gussets will not be securely retained and the bag may not remain sealed under pressure.

Compared with popping by conventional heating, the present invention has several advantages other than those already mentioned. It allows the use of less oil because the corn is heated in large part by direct absorbtion of microwave energy. Thus while the standard popping ratio of three parts corn to one part oil, excellent results are achieved by using 25 parts oil and 66 parts corn when the package of the present invention is employed. The maximum oil temperature obtained using this invention during popping is 325°F. compared with 450°–475°F. for conventional (non-microwave) popping. This probably explains the relatively light texture obtained.

Figure 2:
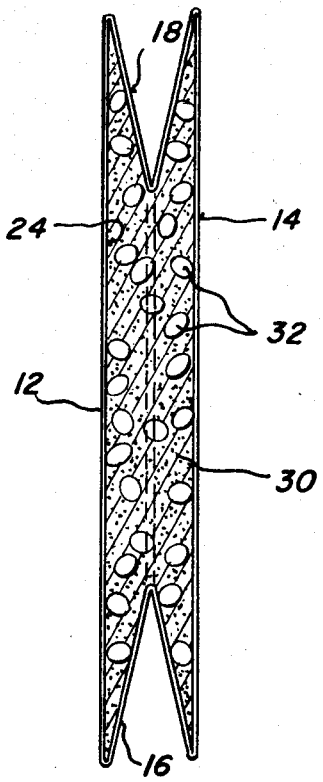
FIG. 2 is a transverse section taken on line 2—2 of FIG. 3.

In the form of the invention shown in FIGS. 2 and 3, the charge of popcorn 32 is in the lower portion of the package 10. The popcorn 32 is mixed with plastic shortening consisting of about 1 to 5 and preferably 2 to 4 parts of shortening for each 8 parts of corn.

While the packages are formed from paper, any flexible non-metallic microwave permeable sheet material can be used which has sufficient heat resistance to withstand the temperatures on the order of about 325°F. The package must be both flexible and expandable. A variety of packaging materials can be used. Polyolefins are satisfactory in most respects but are not usually suitable from the standpoint of toxcity. Nylon and polyester films will provide outstanding results but are more expensive than paper. A paper package consisting of two layers is particularly good. The glasine liner has been found to satisfactorily limit grease absorption by the Kraft paper.

In one preferred embodiment of the invention, the dimensions of the bag when collapsed is 7″ × 10″ with gussets extending two inches toward the center of the package from the side edges. Into the bag of this size is placed about 30 grams of a plastic fat, 10 grams of salt and 80 grams of popcorn.

Among the various shortenings that can be used are any of the well known edible animal/vegetable oils or fats. Vegetable oils and fats are preferred because of their lower melting points. The most suitable include hydrogenated or unhydrogenated cocoanut, peanut oil, cotton seed oil, soybean oil, corn oil, safflower and sunflower oil provided the latter two are of the grade which is relatively high in polyunsaturates. While animal fats can be used, lower melting point oils are much preferred because of the tendency of animals fats to solidify and give the finished popcorn a greasy taste. Butter has been found unacceptable because of its apparent temperature instability and tendency to cause the corn to be burned.

After the package is filled and sealed as shown in the figures, it is preferably placed in refrigerated or frozen storage until it is ready to be used. When the popcorn is to be popped, the package is placed in the cooking chamber 42 of a microwave oven 40 having a capacity of about 600 to 1,400 watts, with a source of microwave energy 46 connected to the oven cavity by means of a wave guide 48 or other suitable energy transfer means. As microwave energy is supplied to the cavity, the package 10 is expanded by steam and then becomes filled with the popped corn.

A preferred method of preparing the package is to place the corn in the bag and then add the fat and salt mixture with the bag held in the position of FIG. 5 to retain the contents in the center. It was found that the fat and salt cannot be placed in the package separately but should be added in the form of the homogenious dispersion. Mixing can be accomplished by placing the fat in a Hobart mixer and mixing at medium speed for a minute until softened. The salt is then added and mixing is continued for about thirty seconds to a minute. The salt should be uniformly distributed to prevent the salt from forming clusters which can become extremely hot during microwave cooking. The bags are loaded with 120 grams of mix for each bag of about 260 cu.in. capacity.

These packages are cooked, if stored frozen, for 1 minute and 45 seconds in a 1,200 watt microwave oven such as a 1,200 watt Litton Industries Inc. oven or for 1 minute and 30 seconds if stored at room temperature.

EXAMPLE 1

A gussetted paper bag as depicted in FIG. 5 is formed from Kraft paper and includes a glasine paper lining having the dimensions 7″ × 10″ with 2″ deep gussets. The bag is filled with 120 grams of a uniform mixture of yellow hybrid popcorn, 80g; cocoanut oil, 30g; and superfine granulated salt, 10g. After the corn and fat is placed in the pouch, it is folded and tape sealed transversely at the top. The package is then frozen. Later upon being placed in a microwave oven of a capacity of 1,200 watts for one minute and 45 seconds, about 22% or less of the popcorn will remain unpopped. The resulting popped popcorn will be crisp and will have a suitable flavor and texture. The amount of burned kernels will be less than 5% and the corn will not be scorched. The bag can be handled immediately by tab 35 and the volume of popped corn will be about 2800 c.c. or more with a volume ratio of popped to unpopped corn of about 35 or above.

What is claimed is:

1. A package of popcorn within a bag which functions as a popping container ready for popping in a microwave oven comprising in combination, a. an expandable package formed from a paper bag provided with longitudinally extending gussets therein to promote the expansion of the bag, b. a layer of grease proof flexible sheet material lining the bag to prevent oil absorption by the paper during storage and microwave popping therein, c. said bag being sealed transversely along the bottom thereof and being folded downwardly along the top edge thereof to retain the top portions of the gussets in place when the bag expands, d. a transversely extending tape means adhesively bonded to the downwardly folded portion and to a portion at the top of the bag adjacent to and immediately below the downwardly folded portion, the top of the bag gussets being held in place by the downwardly folded section of the top edge of the bag and the tape means, e. a rip means attached to the bag for opening the bag, f. said bag having no steam exhaust opening therein, thereby allowing internal pressure to develop to expand the bag when heated to provide an expansion space for the popped corn kernels, g. a charge in the bag consisting essentially of about 8 parts of popcorn in an unpopped condition, about 3 parts of fat, excluding butter, and a quantity of salt, h. said charge of corn, fat and salt being located in the center portion of the bag between said top edge and said bottom thereof and spaced from said top and said bottom edges whereby at least 75% of the corn will pop when placed in a microwave oven having a capacity of 600 to about 1400 watts with less than about 5% of the kernels being scorched during popping.

2. The package of claim 1 wherein the rip means is a tear string provided on the tape to tear the tape longitudinally thereof to thereby free the downwardly folded portion of the bag allowing the bag to be opened at the top.

3. The package of claim 1 wherein the tape extends beyond the side edge of the bag, the part of the tape extending beyond the side edge of the bag can be grasped manually to provide a lifting tab.

4. The package of claim 1 wherein the rip means is a string under the tape to allow opening of the package across substantially its full width when the string is pulled severing the tape.

5. The package of claim 1 wherein said bag is composed of a plurality of sections folded for storage including a center section defined by at least two fold lines extending across the body of the bag, the charge of popcorn, fat and salt in the bag being located in the center section between two of the fold lines and the fat being in a pool in which the unpopped kernels tend to collect, the expansion of the popping corn being thereby free to occur upwardly and laterally in two directions and after the bag is fully inflated the center section having the shape of a hemisphere to promote efficient popping.

* * * * *